United States Patent [19]

Ryan

[11] Patent Number: 4,697,399

[45] Date of Patent: Oct. 6, 1987

[54] UNIVERSAL DECK

[75] Inventor: Thomas G. Ryan, Bethel Park, Pa.

[73] Assignee: Cyclops Corporation, Pittsburgh, Pa.

[21] Appl. No.: 819,614

[22] Filed: Jan. 17, 1986

[51] Int. Cl.[4] ..... E04B 1/70; E04B 1/16; E04B 1/30; E04B 5/18

[52] U.S. Cl. ..... 52/303; 52/310; 52/332; 52/336; 52/448; 52/536; 52/579; 52/630

[58] Field of Search ..... 52/327, 332, 319, 334, 52/336, 450, 448, 537, 536, 588, 579, 630, 303, 310

[56] References Cited

U.S. PATENT DOCUMENTS

| | | | |
|---|---|---|---|
| Re. 26,141 | 1/1967 | Hickman | 52/336 |
| 2,049,863 | 8/1936 | Palmer | 52/303 |
| 2,601,082 | 6/1952 | Ashman | 52/336 |
| 2,641,449 | 6/1953 | Antony | 52/220 X |
| 2,680,775 | 6/1954 | Wiesmann | 52/220 X |
| 2,873,008 | 2/1959 | Ashman | 52/579 |
| 2,899,028 | 8/1959 | Walker | 52/579 |
| 2,933,056 | 4/1960 | Martin | 52/537 X |
| 3,062,338 | 11/1962 | De Ridder et al. | 52/579 |
| 3,458,168 | 7/1969 | White | 52/310 X |
| 3,608,267 | 9/1971 | Curran | 52/588 X |
| 3,720,029 | 3/1973 | Curran | 52/334 |
| 3,812,636 | 5/1974 | Albrecht et al. | 52/221 X |
| 3,886,702 | 6/1975 | Fork | 174/49 X |
| 4,073,110 | 2/1978 | Kennedy | 52/303 |
| 4,106,249 | 8/1978 | Morton | 52/450 X |
| 4,120,131 | 10/1978 | Carroll | 52/310 |
| 4,527,372 | 7/1985 | Ryan | 52/334 |

FOREIGN PATENT DOCUMENTS

| | | | |
|---|---|---|---|
| 0031167 | 7/1981 | European Pat. Off. | 52/319 |
| 2226521 | 11/1974 | France | 52/630 |

*Primary Examiner*—Alfred C. Perham

*Attorney, Agent, or Firm*—Buell, Ziesenheim, Beck & Alstadt

[57] ABSTRACT

A deck structure is disclosed in which overlapping and interlocking corrugated members, each formed from a single sheet of metal, are covered with a layer of concrete. Each corrugated member has at least one longitudinally extending valley along one side and a substantially flat flange provided on an opposite side. The flange may include spaced-apart longitudinally extending shallow depressions spaced at a distance and configured to receive and interlock with an adjacent member. When the decking is used as a deck form, the end portions of the sheet members may be partially or completely closed. Perforations which may be provided in flange portions of the members, allow water and other liquids to drain through deck form and to be caught in a vented valley portions of an adjacent member.

7 Claims, 15 Drawing Figures

UNIVERSAL DECK

BACKGROUND OF THE INVENTION

1. Field of the Invention

This invention relates to a corrugated metal deck structure. More specifically, the invention relates to a deck structure formed from a plurality of overlapping and interlocking corrugated metal sheets resulting in a high strength structure suitable for use in a variety of building and bridge applications.

2. Description of the Prior Art

The use of corrugated metal deck sheets in the building construction field is well-known (see U.S. Pat. No. 3,812,636). U.S. Pat. Nos. 3,074,208 and 3,886,702 illustrate the use of corrugated metal sheets as electrical raceway cells. When used for this purpose, an upper corrugated sheet is typically attached to a lower base sheet to enclose the cells. A problem with these structures is that they cannot be utilized to provide a substantially flat upper surface without the need for additional cover sheets.

The provision of a flat upper surface formed by interlocking corrugated elements is known in connection with a roof decking structure. Such known structures, however, are formed from precast asbestos deck sheets and, to applicant's knowledge, have only been considered as a useful structure for roof decking where a flat upper surface is required to receive overlying roofing materials. The advantages of providing corrugated metal deck sheets including flange portions which cover some or all of the valleys of an adjacent sheet have not been heretofor realized in connection with decking structures used as forms to receive concrete.

The use of corrugated metal sheets is known in connection with the provision of a deck form to receive and initially support an overlying layer of concrete. Such sheets, however, do not have flanges which serve as covers for adjacent valleys and, when so used, the valley portions of the corrugated sheet are typically filled with concrete. In some applications, such as bridge decking, it is undesirable to fill all of the valley portions of the deck sheets with concrete because the additional weight of the concrete in the valleys reduces the maximum span a given deck form can support. When deeper corrugations are provided in a corrugated metal sheets the sheets can generally support a greater load. However, when deeper corrugations are provided, a greater volume of concrete is required to fill such corrugations thereby increasing the weight the sheets must support.

The use of corrugated decking sheets as stay in place bridge deck forms is also known in the art. In such structures, the ends of crest portions of the sheets are generally closed to prevent the ingress of concrete therein. The valley portions of existing bridge deck forms are generally not covered and are completely filled with concrete. Because of this practice, the maximum span which is possible with existing bridge deck forms is unnecessarily limited.

Also in connection with stay in place bridge decking, it is often considered desirable to provide perforations into the deck forms to prevent the trapping of water and salt which may diffuse through the overlying concrete layer. When perforations are provided in existing bridge deck forms, however, concrete slurry falls through the perforations at the time the concrete is initially poured creating a time consuming clean-up job in the area directly under the deck.

There is a need for a corrugated deck sheet which can be utilized as a form to receive concrete and into which deep corrugations may be provided. There further remains a need for such a deck sheet which allows for flexibility in determining which of the valleys will remain uncovered to receive concrete.

There further remains a need for a bridge deck structure which does not require the provision of concrete into all of the valley portions of the corrugated deck sheets. There still further remains a need for a bridge deck structure which allows perforations to be provided in the deck sheets in a manner which prevents slurry from dripping beneath the structure.

SUMMARY OF THE INVENTION

The present invention has solved the above-identified problems and provides a deck structure which, in its simplest form, includes a plurality of overlapping and interlocking corrugated metal sheet members covered with a continuous layer of concrete. Each deck member is formed from a single sheet of metal and has at least one longitudinally extending valley in one side of the sheet. Preferably, the width of the valley or valleys is such that the valleys extend approximately half way across the sheet although, in some embodiments of the invention the valleys may extend a lesser fraction of the way across the sheet. Each valley includes a base portion provided on a first horizontal level and a pair of spaced apart inclined webs extending upwardly from opposite sides of the base and terminating on a second horizontal level. The second level is parallel to and vertically spaced above the first level. A substantially flat flange member is provided on the opposite side of the sheet. The flange extends away from an upper end of a web and is provided on the second level. The flange preferably includes longitudinally extending depressions configured and positioned to receive and interlock a valley or valleys of an adjacent member.

When the present invention is utilized as a floor deck it can provide substantial strength while at the same time cover selected valley portions of each adjacent sheet thereby eliminating the need to fill all of such valleys with concrete. If desired, openings may be placed in the flange allowing concrete to surround and interlock therein. Thus the present invention may be utilized to provide composite action with an overlying concrete slab in much the same way as existing composite decks. Also, it is contemplated that perforations may be provided in the webs to create an acoustical floor deck.

It will be obvious to those skilled in the art that the present invention may also be easily adapted for use in an electrified cellular flooring structure. A series of completely enclosed cells may be formed by overlapping the flange of a first sheet above valley portions of an adjacent sheet. Because all of the sheet edges are exposed to the outside of the cell enclosure, a suitable conduit or raceway is formed. The uniqueness of this system is that cells may be formed in a variety of required groupings or spacings while using only a single product.

The present invention may also be modified to create an improved bridge deck form. Because selected valley portions of the corrugated deck sheets may be covered with the flange portions of adjacent sheets, it is not necessary to provide concrete in every valley. Accordingly, deeper corrugations may be used without increasing but decreasing the volume and weight of concrete required in the overlying concrete layer. Because deeper corrugations may be used, the bridge deck forms of the present invention may be provided over much longer spans than is presently possible with existing bridge deck forms.

In one embodiment of the present invention, a bridge deck member is provided in which flange end portions are pressed downwardly and the base end portions of the valleys are pressed upwardly at opposite ends of each sheet to create a bridge deck form in which the ends of the sheets are closed to prevent ingress of any unwanted concrete.

In the presently preferred bridge deck member, the ends of the valleys and the flanges are closed in the manner described above and vents are provided in the base of the valleys to allow air to circulate therethrough. In this embodiment, perforations are provided in the flange portions to prevent water and salt from being trapped by the stay in place form at the underside of the overlying concrete layer. Because the flanges are positioned above valley portions of adjacent sheets, the concrete slurry and other liquids which drain through the perforations is caught by the valley portions of the adjacent sheet thereby eliminating the clean up problem associated with existing perforated systems. Further, since the valleys are vented, any moisture which drains through the perforations is not trapped in a confined space but rather evaporates into the atmosphere.

It is an object of the present invention to provide a corrugated deck structure in which each deck member includes a flange which may be adapted to serve as a cover for a valley portion of an adjacent member.

It is another object of the invention to provide such a structure, if desired, which may be adapted to provide a substantially flat upper surface.

It is yet another object of the invention to provide such a structure which is stronger and more cost effective than existing deck structures.

It is yet another object of the invention to provide an improved corrugated deck structure which can span longer distances than existing deck forms and one which may have perforations therein to allow venting of the slab without allowing slurry to fall beneath the structure.

These and other objects of the invention will be more fully understood from the following description of the presently preferred embodiments of the invention on reference to the illustrations appended hereto.

DESCRIPTION OF THE PREFERRED EMBODIMENTS

Figure 1:
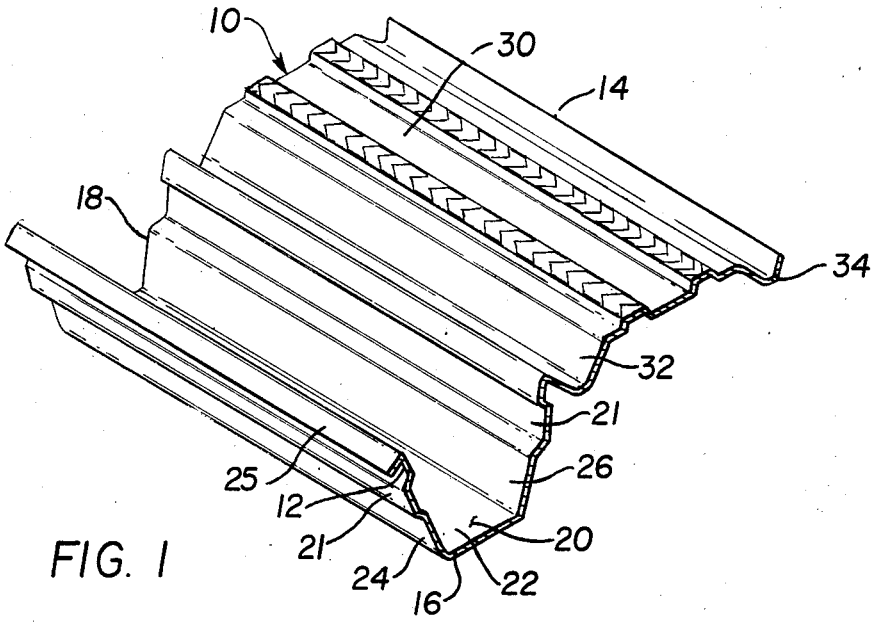
FIG. 1 is an isometric view of a corrugated metal sheet member according to the present invention.
Figure 2:
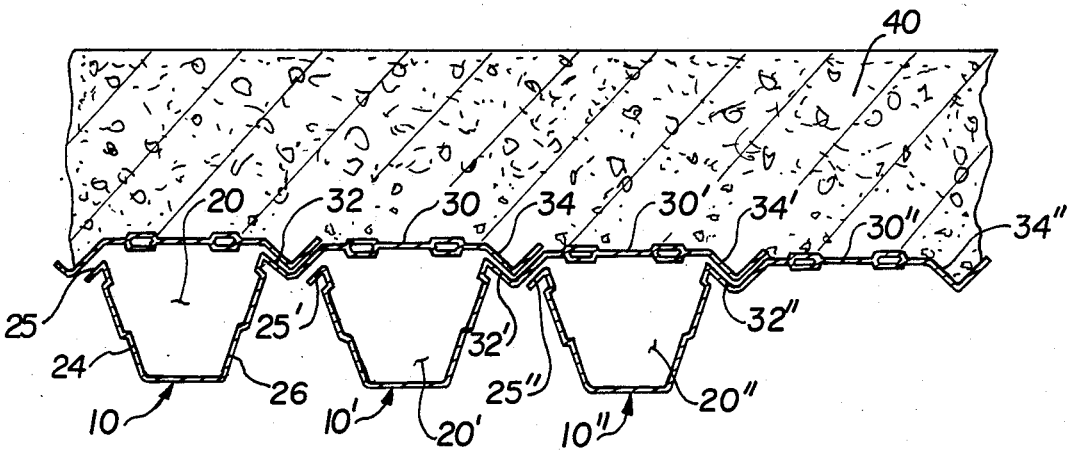
FIG. 2 is a transverse cross-sectional view illustrating a plurality of assembled members according to FIG. 1 and an overlying layer of concrete.

FIGS. 1 and 2 illustrate the simplest form of the present invention in which individual corrugated metal deck members 10 are each formed from a single sheet of metal. A valley 20 is provided in member 10 along one side 12 thereof. Valley 20 extends longitudinally the entire length of the sheet from end 16 to end 18. The valley includes a base portion 22 provided on a first horizontal level and a pair of spaced-apart inclining webs 24 and 26 which extend upwardly from opposite sides of base 22 and terminate on a second horizontal level which is parallel to and vertically spaced above the first level. A narrow flange 25 extends outwardly and downardly from the second horizontal level away from the upper end of web 24. In this embodiment, valley 20 extends approximately half-way across the width of member 10 between sides 12 and 14. Longitudinally extending stiffening ribs 21 are preferably provided in webs 24 and 26.

A substantially flat flange portion 30 is provided on an opposite side 14 of the sheet. Flange 30 includes a pair of spaced-apart shallow depressions 32 and 34. Flange 30 extends away from the upper end of web 26 on the second horizontal level.

Referring to FIG. 2, a series of interconnected members 10, 10' and 10'' are shown as covered by concrete layer 40. Note that the use of primes following a particular reference number throughout the specification refers to corresponding elements or portions thereof where a plurality of identical members are illustrated. Flange 30 of member 10 serves as a cover for valley 20' of member 10'. Longitudinally extending depressions 32 and 34 provided in flange 30 are spaced at a distance and configured to receive and interlock with valley 20'

(flange 25' and depression 32') of adjacent member 10'. Likewise, flange 30' of member 10' serves as a cover for valley 20" of member 10". It will be obvious that various other methods may be used to interlock the web portions to the valleys. A layer of concrete 40 is provided over members 10, 10' and 10".

Figure 3:
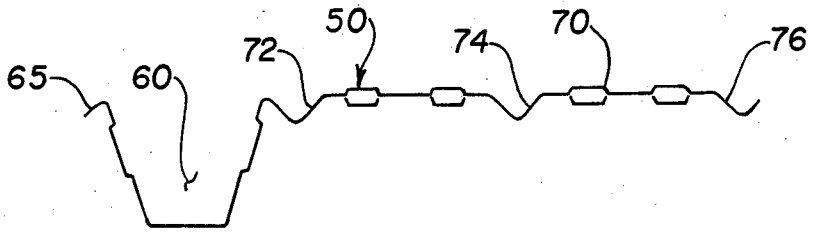
FIG. 3 is a transverse cross-sectional view illustrating an alternate corrugated sheet member according to the present invention having a single valley portion which extends across approximately one-third the width of the sheet.
Figure 4:
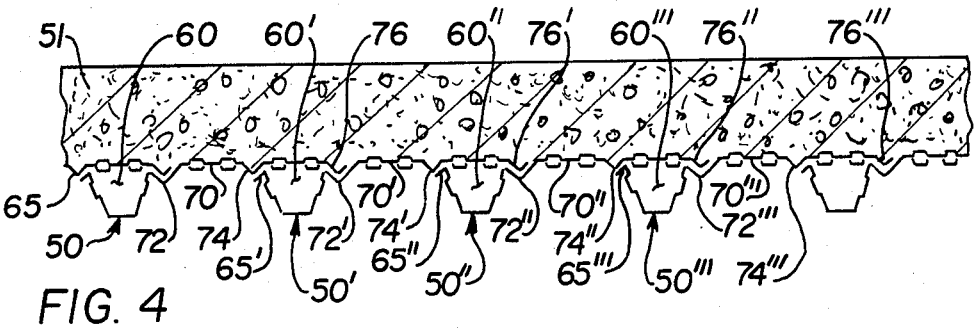
FIG. 4 is a transverse cross-sectional view illustrating a plurality of assembled members according to FIG. 3 and an overlying layer of concrete.

FIGS. 3 and 4 illustrate a second embodiment of the present invention in which decking members 50 are provided with a single valley 60 along one side of the member which extends approximately one-third the distance across the width of member 50. A substantially flat flange 70 extends across the remaining two-thirds of the member. Flange 70 is provided with spaced-apart depressions 72, 74, and 76. A narrow flange 65 is provided at an edge of valley 6. FIG. 4 shows a number of interconnected members 50, 50', 50" and 50'''. Spaced-apart depressions 74 and 76 of flange 70 of member 50 are spaced at a distance and configured to receive and interlock with valley 60' (flange 65' and depression 72') of sheet 50'. Likewise, the flange of each of the members shown serves as a cover for the valley portion of an adjacent member. A layer of concrete 51 is provided over members 50.

Figure 5:
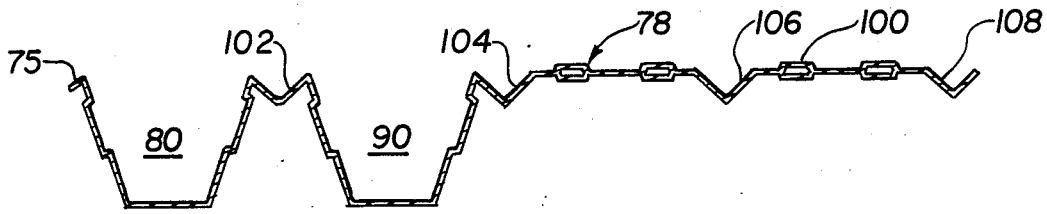
FIG. 5 is a transverse cross-sectional view showing yet another corrugated sheet member according to the present invention having a pair of valleys which extend across approximately one-half of the width of the sheet.
Figure 6:
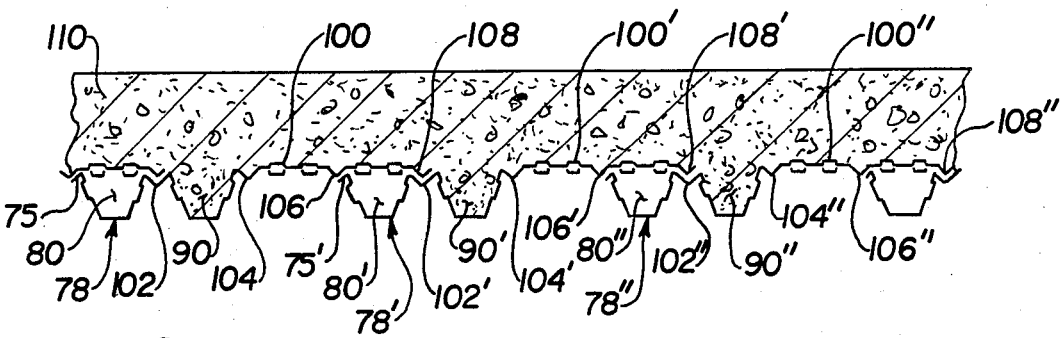
FIG. 6 is a transverse cross-sectional view illustrating a plurality of members according to FIG. 5 assembled in a manner allowing concrete of an overlying layer of concrete to enter only alternating valley portions of the deck.
Figure 7:
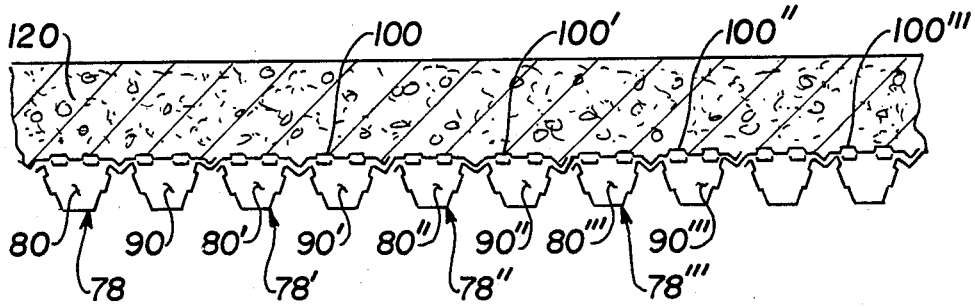
FIG. 7 is a transverse cross-sectional view showing a plurality of members according to FIG. 5 assembled in a manner creating a substantially flat upper surface upon which a layer of concrete is provided.

FIGS. 5 through 7 illustrate yet another embodiment of the present invention in which corrugated metal sheet members 78 are formed to have a pair of valleys 80 and 90 which extend across approximately one-half the width of the member 78. A substantially flat flange portion 100 extends across the remaining half of the member. A narrow flange 75 is provided adjacent valley 80. Spaced-apart depressions 102, 104, 106 and 108 are provided in member 78 for the interlocking purposes described above.

FIG. 6 shows a plurality of interconnected members 78, 78' and 78" with an overlying concrete layer 110 which extends into alternating valleys 90, 90' and 90". An outside portion of flanges 100, 100' and 100" serve as covers respectively for valleys 80', 80" and 80". As in the preceeding embodiments, depressions 106 and 108 of flange 100 of member 78 are spaced at a distance and configured to receive and interlock with valley 80' (flange 75' and depression 102') of adjacent member 78'.

FIG. 7 shows an alternate method of interconnecting members 78, 78", 78" and 78'''. In this embodiment, flanges 100, 100', and 100" serve as covers respectively for valleys 80' and 90', 80" and 90", and 80''' and 90'''. In this embodiment, concrete layer 120 does not enter any of the valley portions of the sheet.

Note that the structure shown in FIG. 7 illustrates a decking arrangement in which there is always at least a double thickness of metal between the top and bottom surfaces of the deck structure. Note also that where the flange of one member terminates, the seam which is created at that location opens only into a valley portion of an adjacent sheet. It will be obvious to those skilled in the art that because of this arrangement, this structure could easily be adapted for use as a radio frequency shield for use in buildings where it is desirable to deter any electronic surveillance of communications occuring within the building. Likewise, it will be obvious that any potential leakage of concrete slurry through the overlapping arrangment of the present invention always becomes entrapped within a valley and never penetrates through the entire deck structure as sometimes occurs in existing deck structures.

Figure 8:
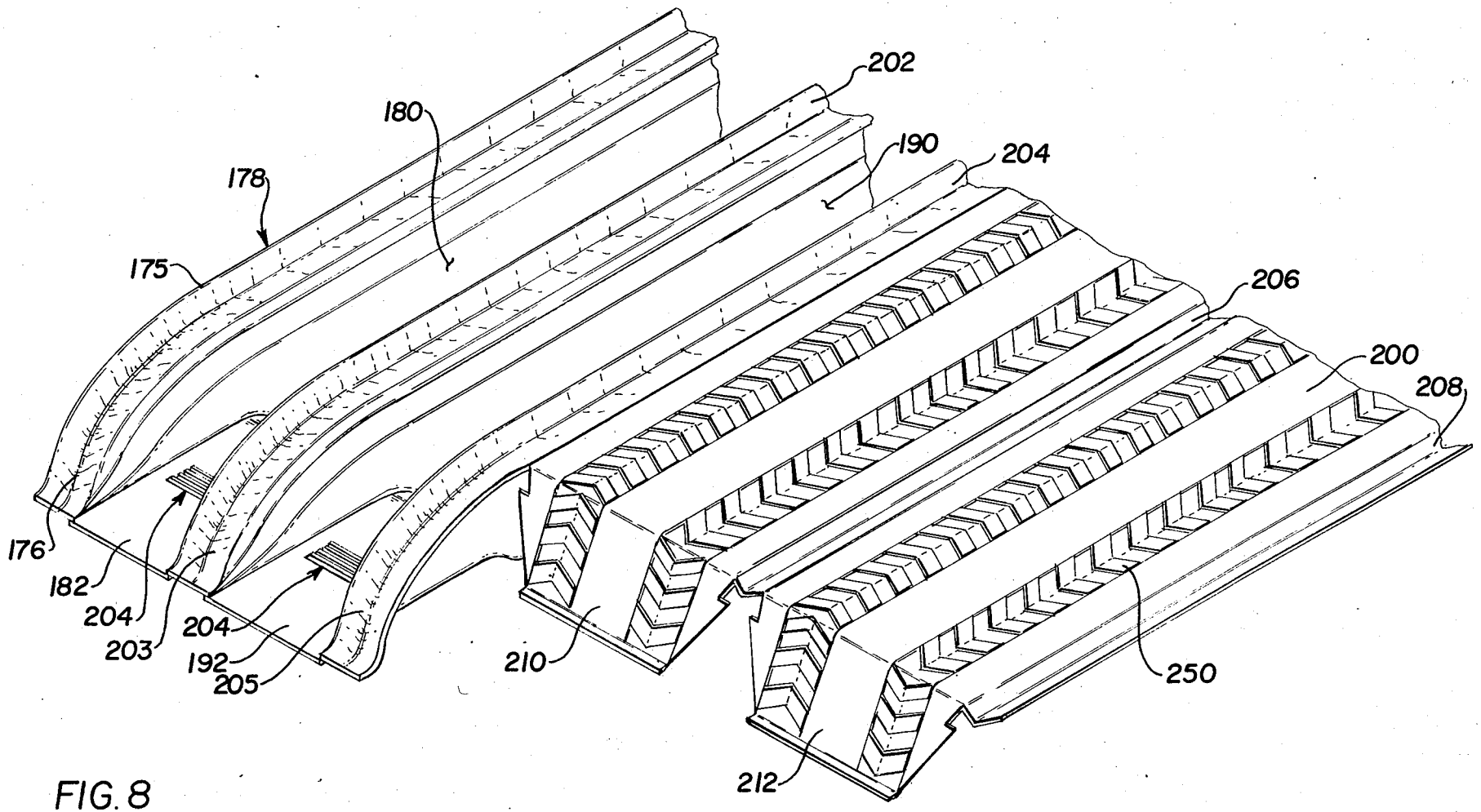
FIG. 8 is an isometric view illustrating a deck having the cross-sectional profile of the FIG. 5 deck and having closed ends.
Figure 9:
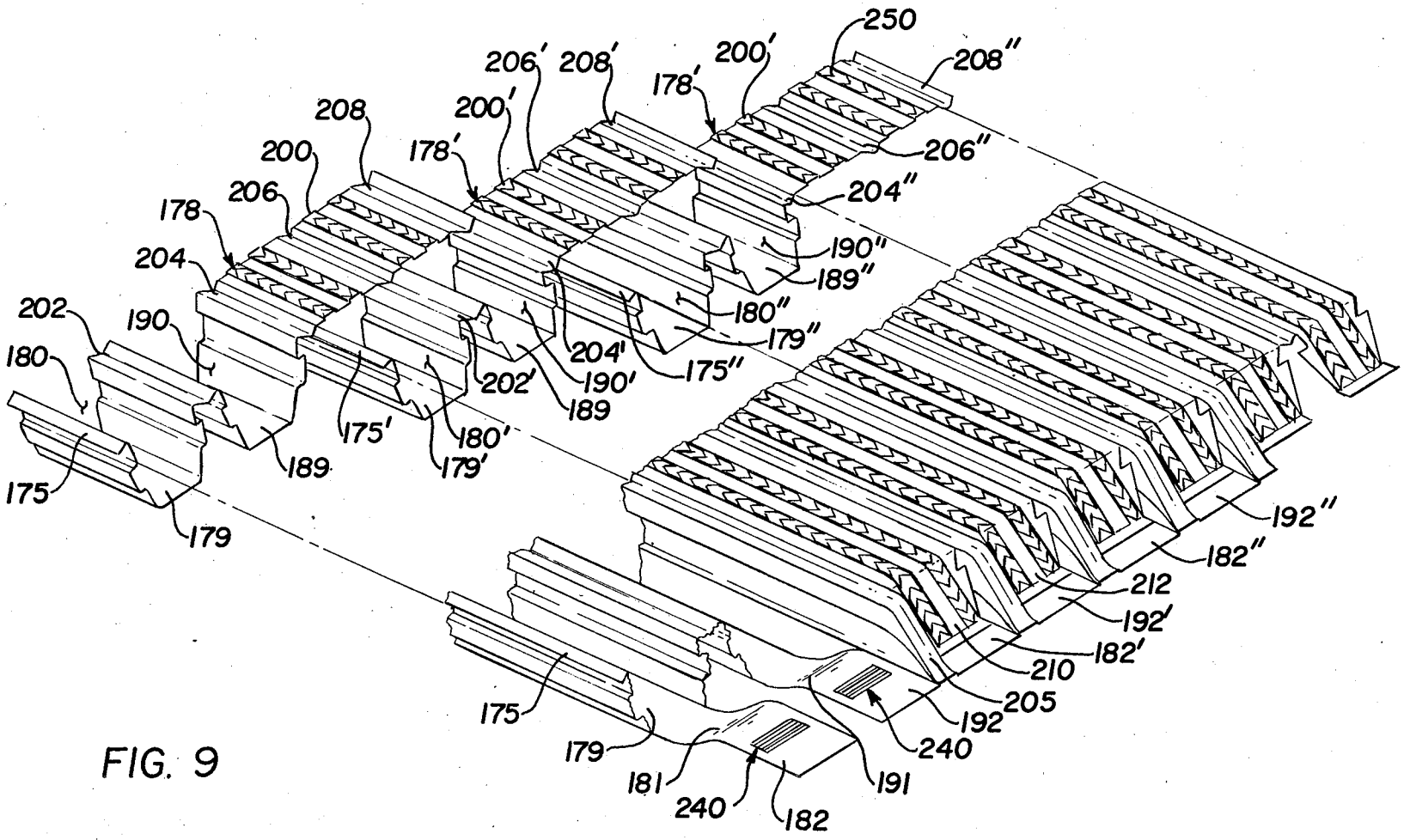
FIG. 9 is an isometric view partially broken away showing a plurality of interconnected deck sheets of the type shown in FIG. 8.
Figure 10:
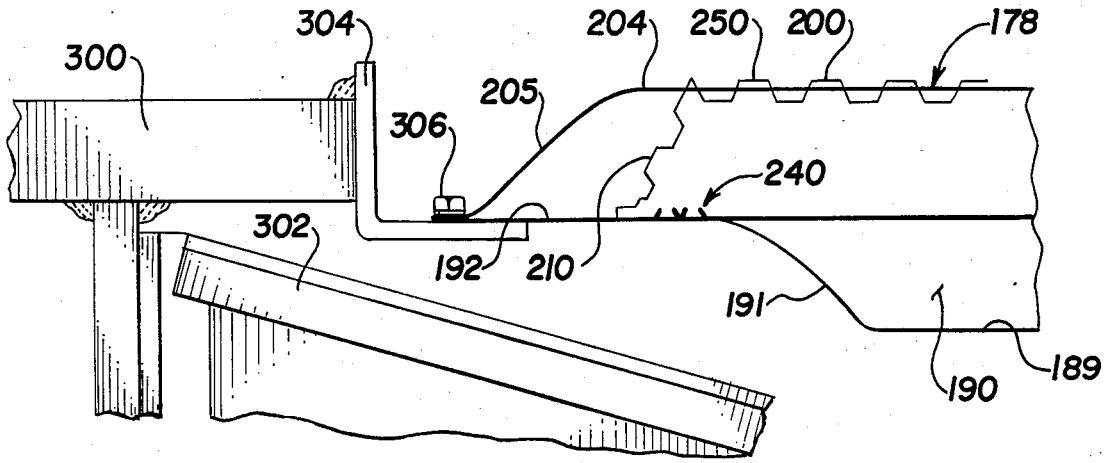
FIG. 10 is a longitudinal cross-sectional view of a decking sheet of the type shown in FIG. 8 and also showing how the deck sheets are attached to a supporting framework.

FIGS. 8, 9 and 10 illustrate one embodiment of the present invention in which opposite ends of decking members 178 are adapted to make the system useful as a form deck. Referring to FIGS. 8 and 10, a central portion of the structure between the closed ends has a tranverse cross-sectional configuration similar to that shown in FIG. 5. Member 178 includes valley portions 180 and 190 and a flange 200. A narrow flange 175 extends outwardly and downwardly from an upper edge of valley 180. As in other embodiments of the present invention, depressions 202, 204, 206 and 208 are provided in member 178 for use in interlocking it with adjacent members.

Near the ends of members 178, base 189 of valley 190 and base 179 of valley 180 are formed to slope upwardly at 191 and 181, respectively. Bases 179 and 189 of valleys 190 and 180 then extend outwardly in a substantially horizontal plane as shown at 192 and 182. Upper valley portions 192 and 182 are substantially coplanar and lie in a plane which is vertically spaced between the first horizontal level of bases 179 and 189 and the second horizonal level of flange 200.

Narrow flange 175 and depressions 202 and 204 each form a crest portion in member 178 and end portions thereof slope downwardly respectively at 176, 203 and 205 and terminate at the level of the upper valley portions 182 and 192. End portions 210 and 212 of flange 200 also slope downwardly and terminate at the level of upper valley portions 182 and 192. Portions 210 and 212, however, preferably slope downardly at a location short of the end of the sheet as best shown in FIG. 8.

FIG. 9 illustrates three interconnected sheets 178, 178' and 178" of the form shown in FIG. 8. Flange portions 210 and 212 rest against valley portions 182' and 192' thereby completely closing valleys 180' and 190' of sheet 178'. Note that portions of the webbing etc. of sheet 178 have been broken away to better show the manner in which bases 179 and 189 of valleys 180 and 190 slope upwardly at 181 and 191.

FIG. 10 illustrates how the deck 178 of the present invention is secured in place when used as a deck form. The deck structure is supported on a suitable girder 300 by means of a support angle 304 and connector 306, as is the common practice. Because the upper valley portion 192 of the sheet slopes downwardly at 191 at some distance from the end of the sheet, there is no interference with intermediate diaphragm 302. Accordingly, the present invention may be installed without any modification to structural frameworks of the type commonly found in existing bridge structures and the like.

Figure 13:
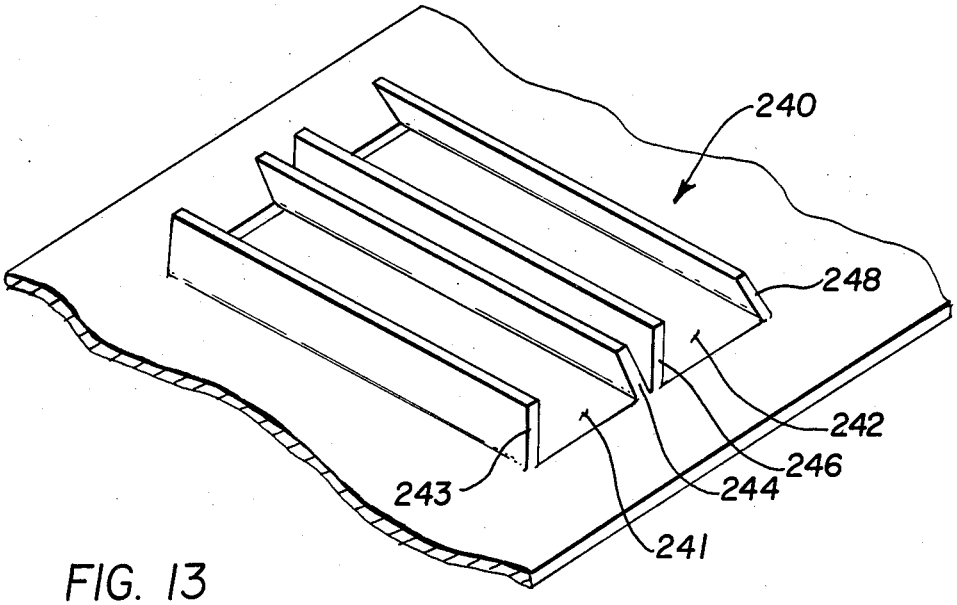
FIG. 13 is an enlarged isometric view of the deck vent means of the present invention.

Vent means 240 are preferably provided in upper valley portions 182 and 192 of members 178 as shown in FIGS. 8, 9, 10 and as best shown in FIG. 13. Vent means 240 is formed by cutting slits 241 and 242 into the valley and forming adjacent portions 243, 244, 246, and 248 upwardly as shown in FIG. 13.

Drain means 250 are also preferably provided in flange portions 200 as shown in FIGS. 8, 9, 10, 11, 12*a*, 12*b* and 12*c*. Drain means 250 are preferably formed by placing embossments into the flange having upwardly extending portions 252 and downwardly extending portions 254 punched to a depth sufficient to cause the material between the upper and lower portions to split creating a plurality of perforations 256 through which liquids may drain. Perforations 256 of drain means 50 are provided in depressions 254 of the drain means so that the openings are provided in the lowest areas of the flange. The drain means open into valleys of adjacent sheets allowing water and salt which may diffuse through an overlying layer of concrete to drain into the valleys.

Because drain means 250 enter into valleys, slurry from concrete which is poured over members 178 will fall into the valleys rather than falling beneath the structure where subsequent cleaning may be required. It is noted that because vent means 240 are provided within each closed valley, liquid which enters a valley through drain means 250 may evaporate and escape through the vent means.

Figure 11:
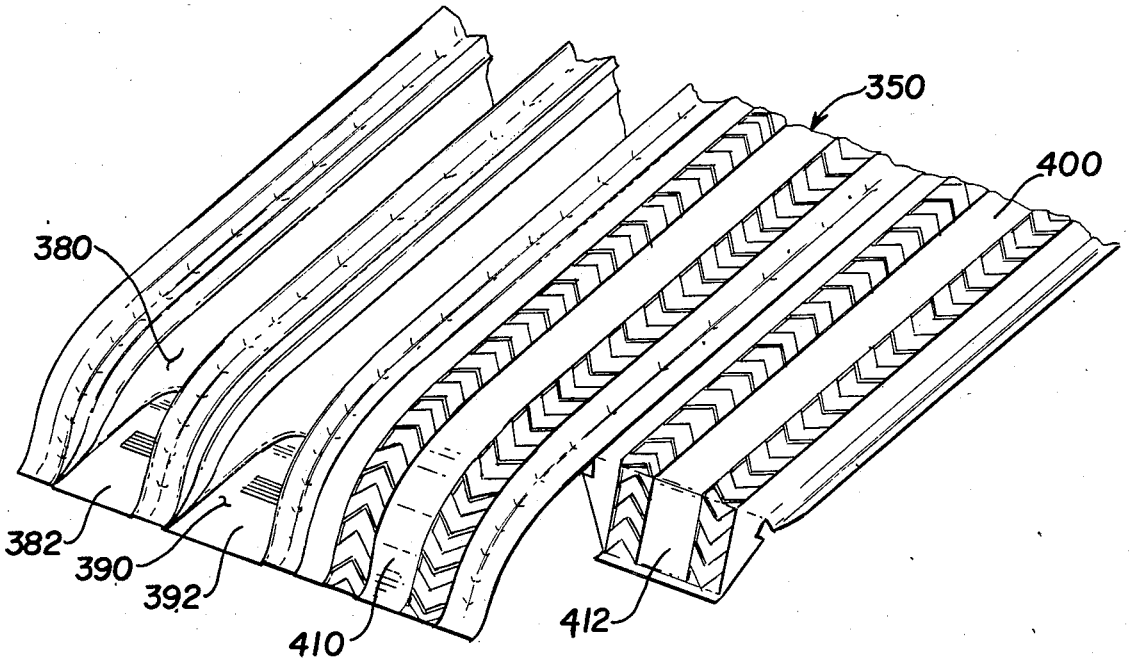
FIG. 11 is an isometric view of another embodiment of the present invention showing a deck with closed ends.
Figure 12A:
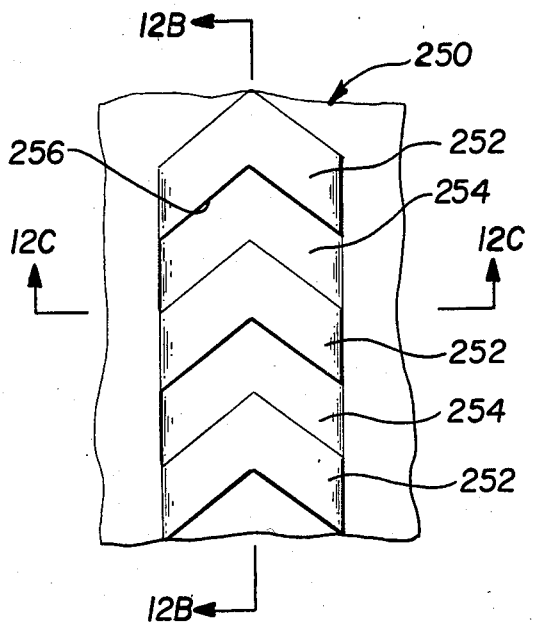
FIG. 12*a* is a top plan view of the drain means of the present invention.
Figure 12B:
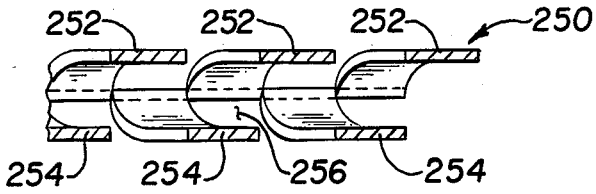
FIG. 12*b* is a longitudinal cross-sectional view taken on the line 12*b*—12*b* of FIG. 12*a*.
Figure 12C:
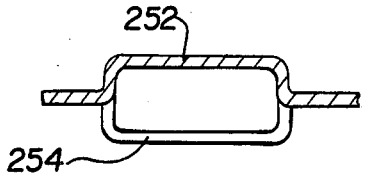
FIG. 12*c* is a transverse cross-sectional view taken on the line 12*c*—12*c* of FIG. 12*a*.

FIG. 11 shows yet another deck form embodiment of the present invention in which a deck member 350 is provided with flange 400 which has a downwardly extending end portion 410 which terminates at the end of the sheet and a second flange end portion 412 which slopes downwardly and terminates at a location short of the end of the sheet. Member 350 of FIG. 11 would be useful in forming a system having a cross-sectional configuration as shown in FIG. 6 whereas the deck 178 of FIG. 8 would be useful in forming a system having a cross-sectional configuration as shown in FIG. 7.

Whereas particular embodiments of the invention have been described above for the purose of illustration, it will be appreciated by those skilled in the art that numerous variations of the details may be made without departing from the invention as described in the appended claims.

I claim:

1. A deck structure comprising:

(a) a plurality of overlapping and interlocking members, each member formed from a single sheet of metal, and having a central portion including at least one longitudinally extending valley provided substantially in one side thereof, said valley including a base portion provided in a first horizontal plane and a pair of spaced apart webs extending upwardly from opposite sides of the base and terminating in a second horizontal plane vertically spaced above said first plane, said central portion of said member also having a substantially longitudinally extending flat flange provided on an opposite side of the sheet and extending away from an upper end of one of said webs in said second plane and covering at least one valley of an adjacent sheet, said deck structure having closed ends formed by cooperating valley base portions and flange portions of adjacent members wherein the base portions of the valleys slope upwardly and terminate in a third horizontal plane located between said first and second planes and the flanges slope downwardly and also terminate in said third plane whereby at least one valley of the deck structure is enclosed; and (b) a continuous layer of concrete extending over and supported at least in part by the flat flange portions of said members.

2. A deck structure according to claim 1 wherein said flange of each member includes at least one longitudinally extending shallow depression configured to receive and interlock with an adjacent member.

3. A deck structure according to claim 1 wherein embossments including drain means in the form of perforations are provided in the flange of at least one member to allow a liquid to drain from a location above the flange into a valley of an adjacent member over which the flange is positioned whereby said embossments aid in securing said concrete layer to the flat flange portions of said members.

4. A deck structure according to claim 1 wherein each member has a single valley which extends across approximately one half the width of the member and the flange extends across the other half.

5. A deck structure according to claim 1 wherein each member has a single valley which extends across approximately one third of the width of the member and the flange extends across the remaining two-thirds.

6. A deck structure according to claim 1 wherein each member has two adjacent valleys which extend across approximately one half the width of the member and the flange extends across the other half.

7. A deck structure according to claim 1 wherein said at least one enclosed valley is provided with vent means.

* * * * *

UNITED STATES PATENT AND TRADEMARK OFFICE

CERTIFICATE OF CORRECTION

PATENT NO. : 4,697,399

DATED : October 6, 1987

INVENTOR(S) : THOMAS G. RYAN

It is certified that error appears in the above-identified patent and that said Letters Patent is hereby corrected as shown below:

Column 5, line 15, change "6" to --60--.

Column 6, line 17, after "a" insert --third horizontal--.

Column 6, line 62, change "50" to --250--.

Signed and Sealed this

Fifteenth Day of March, 1988

*Attest:*

DONALD J. QUIGG

*Attesting Officer*

*Commissioner of Patents and Trademarks*